US010379498B2

(12) United States Patent
Brunet

(10) Patent No.: US 10,379,498 B2
(45) Date of Patent: Aug. 13, 2019

(54) FRAME WITH ROTATING GLASS

(71) Applicant: ZRC Genève SA, Genève (CH)

(72) Inventor: Georges Brunet, Poisy (FR)

(73) Assignee: ZRC GENÈVE SA, Genève (CH)

( * ) Notice: Subject to any disclaimer, the term of this patent is extended or adjusted under 35 U.S.C. 154(b) by 0 days.

(21) Appl. No.: 15/536,557

(22) PCT Filed: Dec. 14, 2015

(86) PCT No.: PCT/EP2015/079541
§ 371 (c)(1),
(2) Date: Jun. 15, 2017

(87) PCT Pub. No.: WO2016/096691
PCT Pub. Date: Jun. 23, 2016

(65) Prior Publication Data

US 2017/0364032 A1 Dec. 21, 2017

(30) Foreign Application Priority Data

Dec. 16, 2014 (FR) ..... 14 62496

(51) Int. Cl.
*G04B 19/28* (2006.01)

(52) U.S. Cl.
CPC ..... *G04B 19/283* (2013.01); *G04B 19/286* (2013.01)

(58) Field of Classification Search
CPC .... G04B 19/28; G04B 19/283; G04B 19/286; G04B 19/22
USPC ..... 368/295
See application file for complete search history.

(56) References Cited

U.S. PATENT DOCUMENTS 3,271,945 A * 9/1966 Anderson ..... G04B 19/166 368/22
6,010,241 A * 1/2000 Bulgari ..... G04B 3/08 368/187
7,137,732 B2 * 11/2006 Takeda ..... G04B 19/283 368/295
7,307,916 B2 * 12/2007 Vogt ..... G04B 19/283 368/21

(Continued)

FOREIGN PATENT DOCUMENTS

CH 499 808 A 8/1970
CH 684 919 B5 8/1995

(Continued)

OTHER PUBLICATIONS

International Search Report and Written Opinion dated Feb. 18, 2016 in corresponding International Application No. PCT/EP2015/079541.

*Primary Examiner* — Sean P Kayes
(74) *Attorney, Agent, or Firm* — Haug Partners LLP

(57) ABSTRACT

Frame comprising a case body (3) and a glass (13) rotatably mounted on said case body, in which at least one interior annular channel (26) is arranged between the glass and the case body and comprising at least one holding means (32) of the glass on the case body and, between the glass and the case body, a non-return means (35, 38), said means being arranged at least partially in said interior annular channel (26), in which frame the glass has at least one through passage (39), left free, for access to said interior annular channel (26), providing permanent communication of said channel with the exterior.

14 Claims, 6 Drawing Sheets

(56) References Cited

U.S. PATENT DOCUMENTS

| | | | | |
|---|---|---|---|---|
| 7,614,785 | B2 * | 11/2009 | Hiranuma | G04B 19/283 368/294 |
| 8,505,196 | B2 * | 8/2013 | Altenhoven | G04B 39/00 29/10 |
| 8,971,158 | B2 * | 3/2015 | Grossenbacher | A44C 17/04 368/232 |
| 9,851,695 | B1 * | 12/2017 | Roth | G04B 19/283 |
| 9,977,403 | B2 * | 5/2018 | Leoni | G04B 37/1486 |
| 2004/0141424 | A1 * | 7/2004 | Hartmann | G04B 19/283 368/295 |
| 2005/0141347 | A1 * | 6/2005 | Takeda | G04B 19/286 368/295 |
| 2010/0220560 | A1 * | 9/2010 | Hiranuma | G04B 19/286 368/295 |
| 2013/0201804 | A1 * | 8/2013 | Bertrand | G04B 19/283 368/281 |
| 2014/0098650 | A1 * | 4/2014 | Antille | G04B 19/283 368/295 |

FOREIGN PATENT DOCUMENTS

| | | |
|---|---|---|
| JP | S60 98086 U | 7/1985 |
| JP | H04 11489 U | 1/1992 |

* cited by examiner

FRAME WITH ROTATING GLASS

CROSS-REFERENCE TO RELATED APPLICATIONS

This application is the National Stage entry under 35 U.S.C. § 371 of International Application No. PCT/EP2015/079541 filed on Dec. 14, 2015, published on Jun. 23, 2016 under Publication Number WO 2016/096691, which claims the benefit of priority under 35 U.S.C. § 119 of French Patent Application Number 1462496 filed Dec. 16, 2014.

The present invention relates to the field of watches, in particular diving watches.

Underwater diving watches, or the like, are commonly equipped on the periphery with a watch crystal or glass, a bezel, assuming the form of a ring, mounted rotating on the middle. In the case of a diving watch, the bezel must be rotating, unidirectional and notched.

By rotating this bezel, which, in the case of diving use, must only rotate in the counterclockwise direction, it is possible to place an origin index that it bears facing the minute hand to constitute a time origin, then, later, to observe the time elapsed since this origin by looking at the position of the minute hand relative to the time of origin index indicated on the bezel. This makes it possible to calculate the submersion time, and therefore the decompression levels.

To be able to rotate, the bezel is mounted with a certain amount of play on the middle, such that the sea salt or any other particles considered to be pollutants can accumulate between the bezel and the middle during submergence. This accumulation generally causes corrosion of the metals and damage to the mounting, unidirectional nature and anti-return means of the bezel on the middle, which are extremely sensitive to sea salt and favorable to the accumulation of pollutants, which may result in blockage of the bezel, making it impossible to measure the time.

This is also the major cause of diving watch repairs, essentially due to the blockage of the non-return system by the accumulated salt crystals. The only solution is then to disassemble the bezel, clean it by ultrasound and change the non-return system.

The present invention aims to resolve such drawbacks.

A watch is proposed that comprises a middle and a bezel mounted rotating on this middle, in which at least one annular inner channel is arranged between the bezel and the middle and which comprises, between the bezel and the middle, a means for maintaining the bezel on the middle and a non-return means, these means being arranged at least partly in said annular inner channel.

The bezel has at least one through passage, left free, for permanent access to said annular inner channel, placing this channel permanently in communication with the outside.

Thus, this through passage constitutes a flow means to prevent the buildup of polluting products in said channel by water circulation, and therefore the cleaning of this channel.

Said through passage can extend radially.

Said through passage can be oblong in the peripheral direction of said bezel. This shape makes it possible to avoid capillarity effects.

Said through passage can have a smooth wall.

Said through passage can have a constant section from one of its openings to the other emerging on the one hand inside said annular inner channel and on the other hand toward the outside.

The bezel and the middle can have adjacent surfaces situated on either side of said annular inner channel and said through passage.

The non-return means can on the one hand comprise a non-return member subject to a spring and on the other hand a non-return toothing.

The maintaining means can comprise a spring with faces engaged in annular grooves of the bezel and the middle, these grooves emerging in said annular inner channel.

Said through passage can have, in the axial direction, a thickness comprised between one third and two thirds of the thickness of the bezel.

Said through passage can have, in the peripheral direction, a length comprised between one and two times the thickness of the bezel.

The length of said through passage, in the circumferential direction, can be at least equal to four times its width, in the direction of the axial thickness of the rotating bezel.

Said through passage can extend over an angular sector comprised between twenty and thirty degrees.

A watch will be described as one non-limiting example, illustrated by the drawing, in which.

Figure 1:
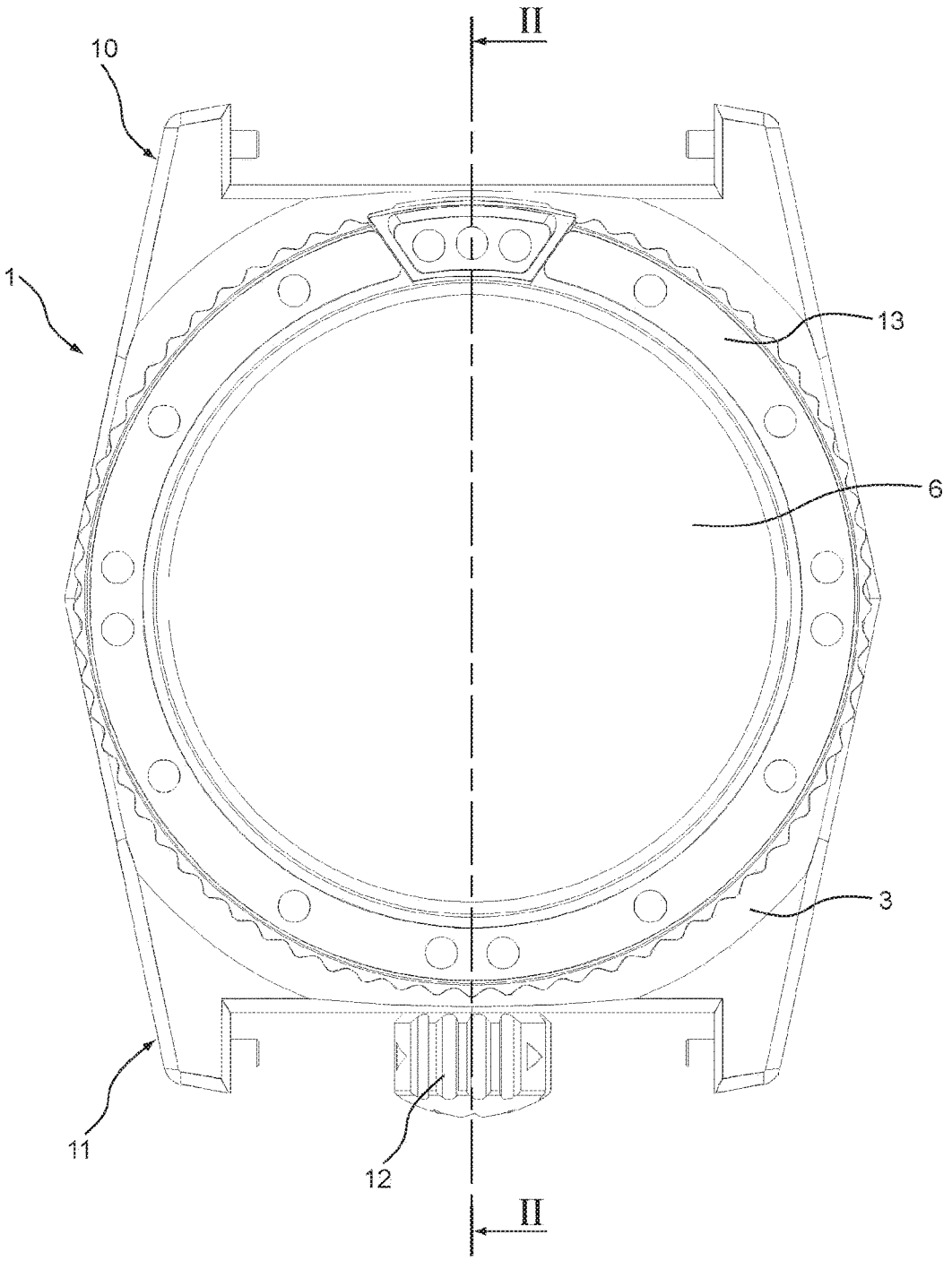
FIG. 1 shows a top view of this watch, arranged flat.
Figure 2:
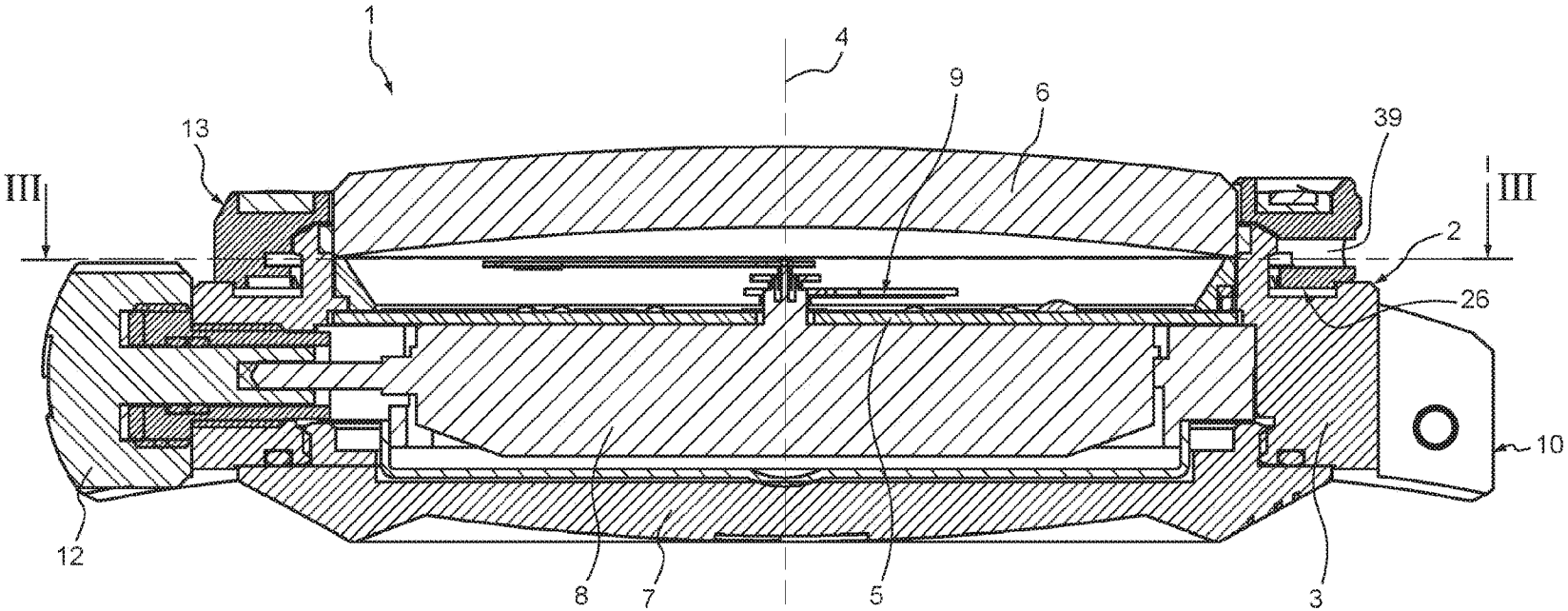
FIG. 2 shows a vertical sectional view of this watch, along II-II of FIG. 1.
Figure 3:
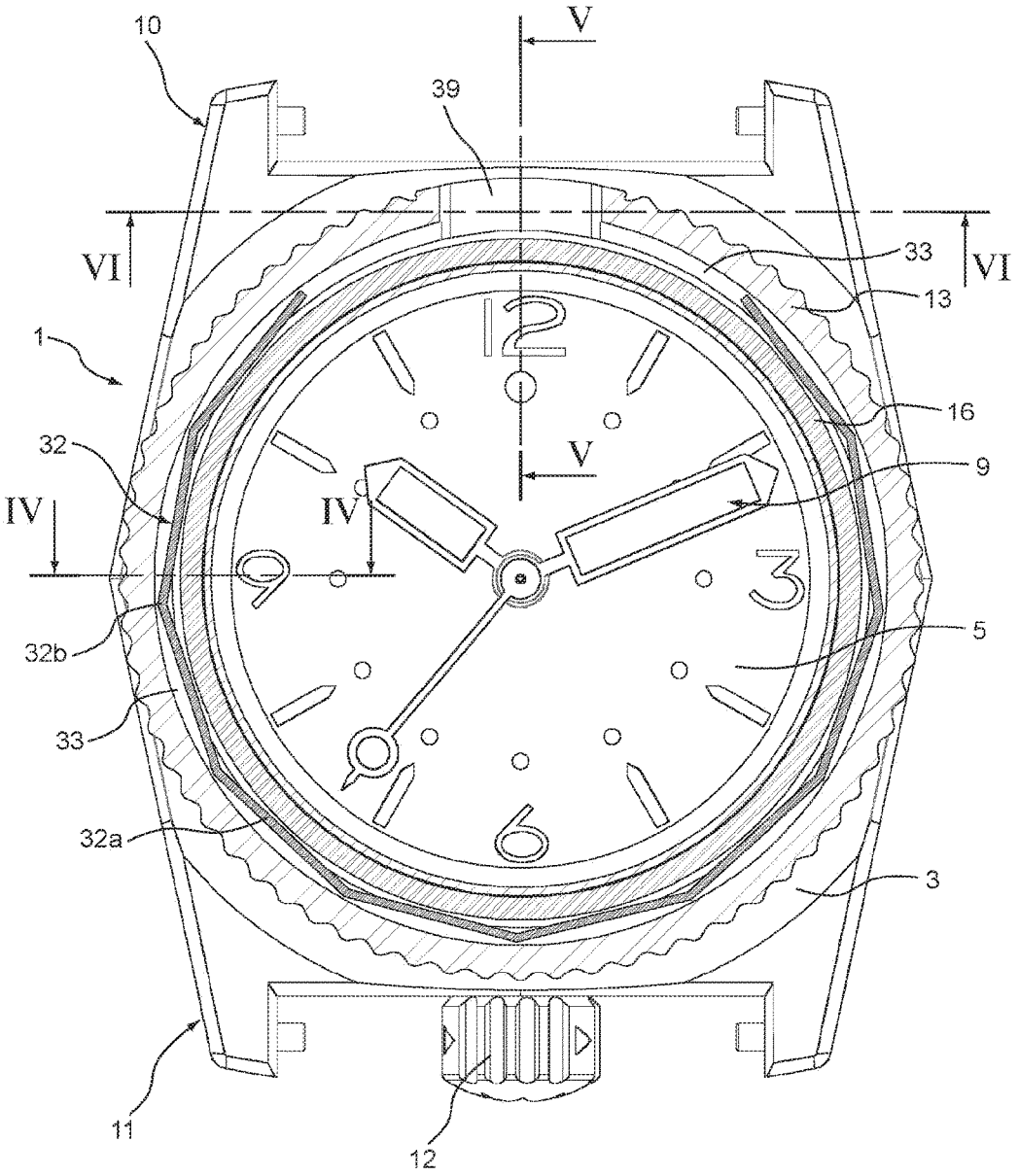
FIG. 3 shows a top view of this watch, partially in section along III-Ill of FIG. 2.

As illustrated in FIGS. 1 to 3, a watch 1, in particular a diving watch, comprises a case 2 that comprises a middle 3 that assumes the general form of a ring, for example circular, and that has an axis 4, the latter being considered in a vertical position for the needs of the present description.

The middle 3 is suitable for supporting a radial dial 5 assuming the form of a disc, positioned inwardly in an intermediate position between an annular inner shoulder of the metal, a radial watch crystal or glass 6 fastened in an upper part of the middle and a radial bottom 7 coupled to the lower part of the middle 3 by a thread.

In the space between the dial 5 and the bottom 7, a watch mechanism 8 is mounted that is provided, via a central passage of the dial 5, with radial hands 9 positioned in the space between the dial 5 and the watch glass 6.

The middle 3 comprises opposite pairs of outer horns 10 and 11 for mounting watch bracelets. The watch mechanism is provided with an outer rotating screwed crown 12 for setting the time, the shaft of which radially traverses the middle 3 to be coupled to the watch mechanism 8. According to the illustrated example, the screwed crown 12 is placed between two pairs of horns.

On the upper part of the middle 3, a bezel 13 is mounted, turning or rotating, in one direction only, relative to the middle 3 and assuming the form of a notched ring, the specific mounting and specific structure of which will now be described as example embodiments.

Figure 4:
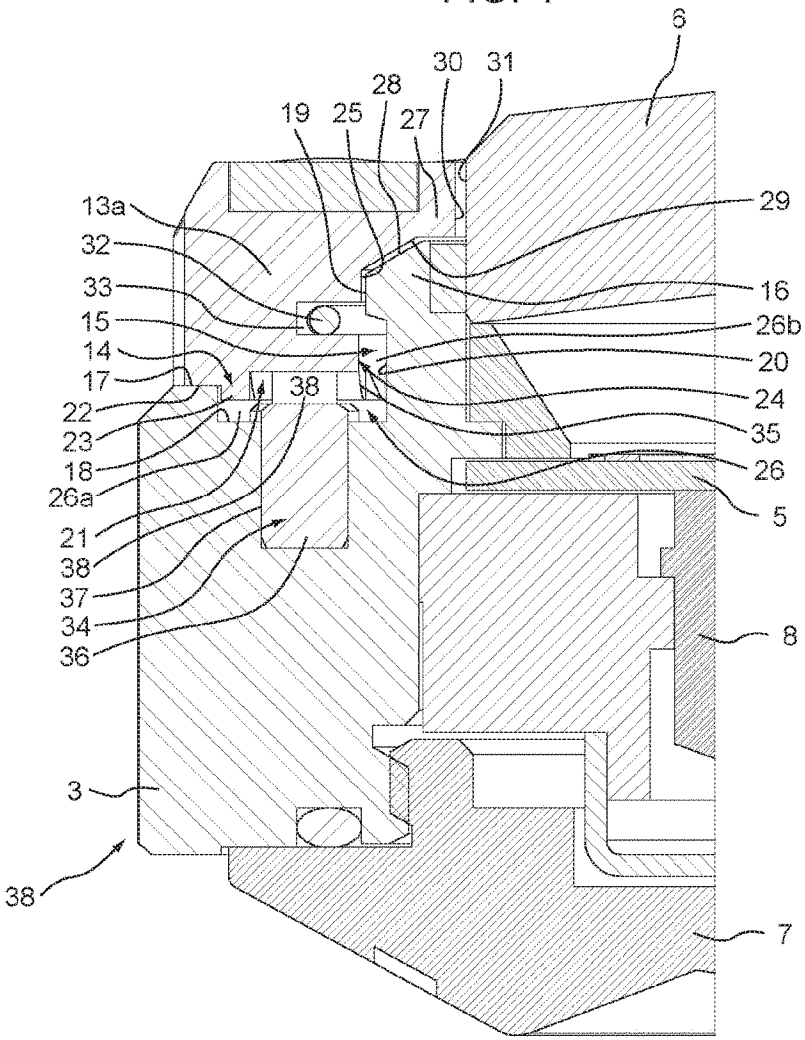
FIG. 4 shows a local vertical section along IV-IV of FIG. 3.
Figure 5:
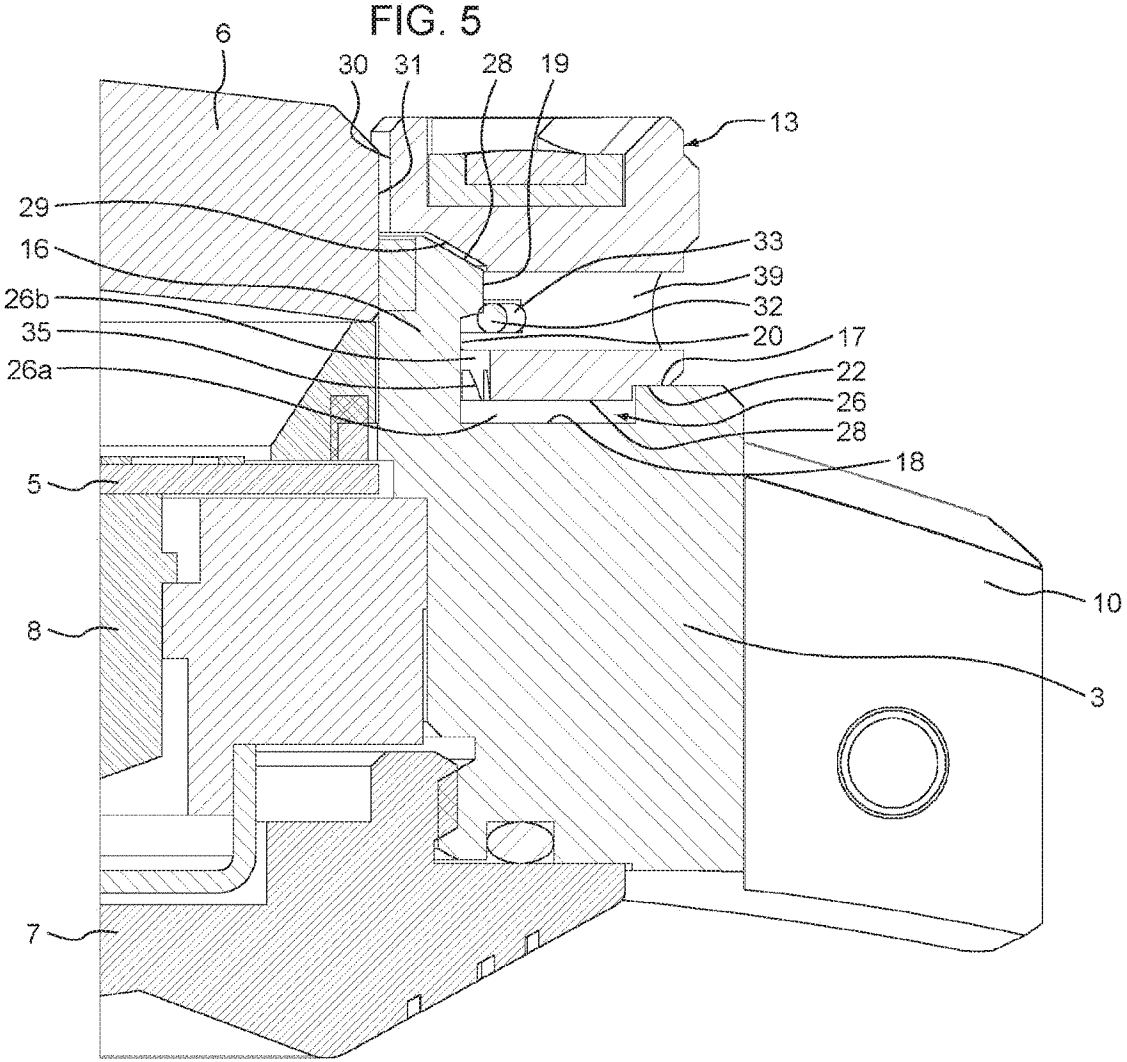
FIG. 5 shows another local vertical sectional view along V-V of FIG. 3.

As illustrated in particular in FIGS. 4 and 5, the upper part of the middle 3 has an annular free space, in the form of an annular rebate, that is determined by an annular flank 14 oriented upward and an annular flank 15 oriented radically outward, this annular flank 15 being determined by an annular portion 16 of the middle 3 protruding upward relative to the annular flank 14.

The annular flank 14 of the middle 3 comprises a peripheral radial annular axial abutting surface 17 and an annular groove 18 withdrawn downward relative to this abutting surface 17 and situated between this banking surface and the annular portion 16.

In its upper part, the annular flank 15 comprises a cylindrical surface 19, and, between this cylindrical surface 19 and the annular flank 14, a cylindrical groove 20 situated below this cylindrical surface 19 and rejoining the annular groove 18.

The rotating bezel 13 comprises an annular portion 13*a* that is engaged in the aforementioned free space and that has a lower flank 21 that comprises a radial abutting surface 22 adjacent to the abutting surface 17 of the middle 3 and an annular shoulder 23 protruding downward relative to this abutting surface 22 and engaged in the annular groove 18 of the middle 3, without reaching the bottom thereof.

The annular portion 13*a* of the rotating bezel 13 has an inner flank 24 that comprises a cylindrical surface 25 adjacent the cylindrical surface 19 and across from the annular groove 20 of the portion 16 of the middle 3.

Thus, the middle 3 and the rotating bezel 13 develop, between them, an annular inner channel 26 that comprises a radial part 26*a* extending between the bottom of the annular groove 18 of the middle 3 and the lower face of the annular shoulder 23 of the rotating bezel 13 and an axial part 26*b* extending between the bottom of the annular groove 20 of the annular portion 13*a* of the rotating bezel 13 and the cylindrical surface 25 of the rotating bezel 13. The radial part 26*a* and the axial part 26*b* are L-shaped in section.

Furthermore, the rotating bezel 13 has an annular portion 27 that extends above the annular portion 16 of the middle 3, these annular portions 16 and 27 having adjacent surfaces 28 and 29. Furthermore, the annular portion 27 of the rotating bezel 13 has a cylindrical inner surface 30 adjacent to a peripheral cylindrical surface 31 of the watch glass 6.

The play that may potentially exist between the adjacent surfaces 17 and 22, between the adjacent surfaces 19 and 25, between the adjacent surfaces 28 and 29 and between the adjacent surfaces 30 and 31 constitutes an operating play of little thickness, while the radial part 26*a* and the axial part 26*b*, forming the annular inner channel 26, specially made and developed to that end to allow the free circulation of water as well as cleaning, determine radial and axial inner spaces or channels whose thicknesses are noticeably larger than the thicknesses of this operating play.

According to one example embodiment, as illustrated in particular in FIGS. 3, 4 and 5, the rotating bezel 13 is maintained on the middle 3 via a maintaining spring 32 mounted as follows.

In the flank 24 of the rotating bezel 13, an annular groove 33 is arranged, open toward the junction zone between the annular surface 19 and the annular groove 20 of the annular portion 15 of the middle 3.

The maintaining spring 32 is made up of a wire with sides configured in the form of an incomplete regular polygon. This maintaining spring with sides 32 is engaged in the annular groove 33 of the rotating bezel 13 and cooperates with the annular portion 16 of the middle 3. The maintaining spring 32 extends over part of the perimeter of the annular groove 33, for example over about three quarters.

The maintaining spring 32 is built such that the central portions of its sides 32*a* are slightly engaged in the groove 14 of the portion 16 of the middle 3 and bear on the junction corner between the annular surface 19 and the annular groove 20 of the annular portion 15 of the middle 3, while its apices 32*b*, rejoining these sides 32*a*, are adjacent to the bottom of the annular groove 33 of the rotating bezel 13 or in contact on this bottom.

In this maintaining position of the maintaining spring 32, the rotating bezel 13 is stressed downward such that the radial abutting surfaces 17 and 22 of the middle 3 and the rotating bezel 13 are maintained axially abutting.

When the user rotates the rotating bezel 13 relative to the middle 3, the maintaining spring 32 slides over the aforementioned junction corner and/or in the annular groove 24 and the radial abutting surfaces 17 and 22 slide on one another. The centering of the rotating bezel 13 can be ensured by sliding of the flank of the shoulder 23 against the flank of the groove 18 on one another and/or by sliding of the surfaces 19 and 25 on one another and/or by bearing of the maintaining spring 32 on the bottom of the groove 33 and on the aforementioned junction corner.

To mount the rotating bezel 13 on the middle 3, the rotating bezel 13 is engaged around the annular portion 16 of the middle 3. The maintaining spring 32 deforms in the direction of its penetration in the annular groove 33 of the rotating bezel 13, slides over the surface 19 of the annular portion 16, then deforms in the other direction to reach and assume its maintaining position described above.

According to one example embodiment, as in particular illustrated in FIGS. 4 and 6, the rotating bezel 13 can only rotate in one direction relative to the middle 3 owing to the presence of a non-return means 34 formed as follows.

The shoulder 23 of the rotating bezel 13 has a non-return toothing 35 oriented toward the bottom of the annular groove 18 of the middle 3.

The body 36 of the non-return means 34 is mounted in an axial hole 37 of the middle 3 and comprises a non-return member 38 subject to a spring, inserted in the body 36 and not shown, stressing it toward the toothing 35. The non-return toothing 35 and non-return member 38 are arranged so that the non-return member 38 can pass, in a rotation direction of the rotating bezel 13 relative to the middle 3, above the non-return toothing 35 and, in the other rotation direction, engage with the tooth, of the non-return toothing 35, corresponding to the reached position. Sixty teeth are provided for sixty notches to index each of the sixty seconds making up a minute.

Figure 6:
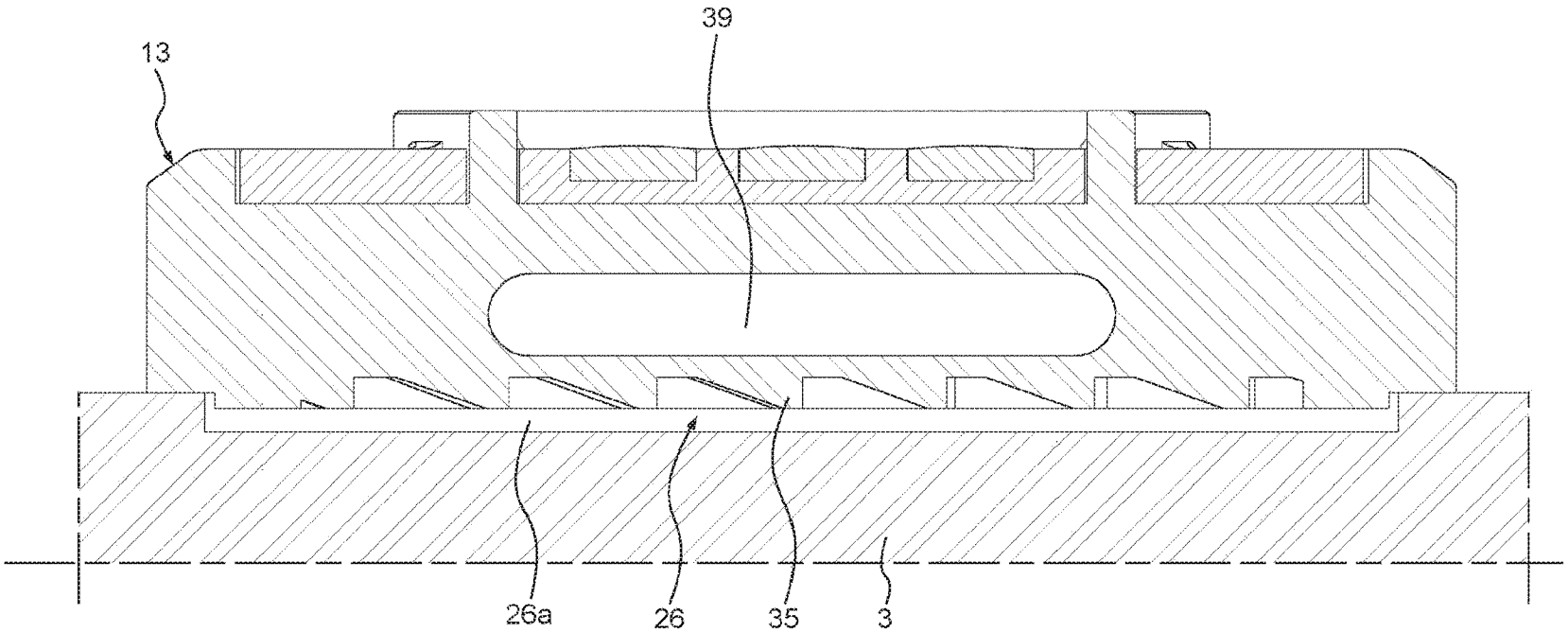
FIG. 6 shows another local vertical sectional view along VI-VI of FIG. 3.

As illustrated in particular in FIGS. 2, 5 and 6, the rotating bezel 13 has a through access passage 39, left free, allowing, only and exclusively, the annular inner channel 26 to be placed in permanent communication with the outside.

According to one example embodiment, as shown, the through passage 39 is arranged radially through the rotating bezel 13 and emerges in the part 26*b* of the annular inner channel 26 and in the zone of the annular inner groove 38 of the rotating bezel 13.

According to one example embodiment, the wall of the through passage 39 is smooth.

According to one example embodiment, the through passage 39 has a constant section from one of its openings to the other emerging on the one hand inside the annular inner channel 26 and on the other hand toward the outside.

For example, the through passage 39 may have, in the axial direction, a thickness comprised between one third and two thirds of the thickness of the rotating bezel 13 and, in the peripheral direction, a length comprised between one and two times the thickness of the rotating bezel 13. For example, said through passage extends over an angular sector, relative to the center of the watch, comprised between twenty and thirty degrees.

According to one advantageous embodiment, the through passage 39 has an oblong or elongated shape along the peripheral direction of the rotating bezel 13. In a manner that is easy to execute, this oblong shape can result from a piercing operation by moving the shaft of the drill for example parallel to itself in the peripheral direction of the bezel. Nevertheless, this oblong shape can be different. For example, it may be rectangular or result from two piercings spaced apart in the circumferential direction and a milling connecting these two piercings and having a width smaller than the diameters of these piercings. Preferably, the length of this oblong shape, in the circumferential direction, is at least equal to four times its width, in the direction of the axial thickness of the rotating bezel 13.

When the watch 1 is used, polluting products can build up in all locations where the rotating bezel 13 is opposite or in contact with the middle 3 and the watch glass 6, as previously described.

More particularly, polluting products can build up in the locations in which the rotating bezel 13 is opposite and/or in contact with the middle 3 and the watch glass 6 and in which the mounting means and the non-rotation means are found.

Such pollution may result in an attack on the component metals and blocking of the rotating bezel 13 relative to the middle 3. This is the case in particular when the watch 1 is used in a marine environment in which the main pollutant is salt.

Owing to the existence of the through passage 39, which is left free at all times, a mixing effect occurs of the water in the annular inner channel 26 through the through passage 39, which, during everyday use, limits the risk of accumulation and stagnation of pollutants in the annular inner channel 26 opened by the through passage 39.

Furthermore, the user can perform rinsing. For example, the user submerges the watch 1 in fresh and clean water or places it under a stream of water leaving a faucet and rotates the rotating bezel 13 relative to the middle 3 so that the opening created by the through passage 39 circumferentially sweeps the annular inner channel 26.

In so doing, the fresh and clean water penetrates and circulates in the annular inner channel 26 and leaves it while generating a significant stream of water. The stream carries the pollutants with it and cleans the annular inner channel 26, the rotating means, the non-return means and any slots that may exist between said opposite surfaces of the rotating bezel 13 relative to the middle 3 and the watch glass 6.

The sections and shapes of the annular inner channel 26 and the through passage 39 are large enough for the capillarity effects of the water not to oppose the desired flow of water and rinsing through the through passage 39 and in the inner annular channel 26.

The present invention is not limited to the example described above. In particular, the rotating bezel could have several through cleaning passages. The through cleaning passage could be arranged along a direction other than the radial direction. The mounting of the rotating bezel on the middle and the unidirectional non-return means in one direction could have different structures, implementing other mechanical means. Many alternative embodiments are possible without going beyond the scope of the invention.

The invention claimed is:

1. A watch comprising:

a middle; and a bezel mounted rotatingly on the middle, wherein at least one annular inner channel is arranged between the bezel and the middle, the at least one annular inner channel comprising:

a maintaining spring for directly maintaining, in the axial direction, the bezel on the middle, wherein the maintaining spring comprises a wire; and a non-return means, between the bezel and the middle, comprising a non-return member stressed by a spring against a non-return toothing, the non-return means configured to allow the bezel to only rotate in a single direction, wherein the maintaining spring and non-return means are arranged at least partly in said annular inner channel, and wherein the bezel has at least one through passage open for water flow and communicating with the said annular inner channel for permanent access to said annular inner channel, placing the channel permanently in communication with the outside, wherein the at least one through passage extends through a sidewall of the bezel, wherein the at least one through passage extends only over an angular sector, the angular sector being less than three hundred and sixty degrees, wherein the bezel further comprises an annular groove open towards the at least one through passage, and wherein the maintaining spring is located within the annular groove.

2. The watch according to claim 1, wherein said through passage extends radially.

3. The watch according to claim 1, wherein said through passage is oblong in a peripheral direction of the bezel.

4. The watch according to claim 1, wherein said through passage has a smooth wall.

5. The watch according to claim 1, wherein said through passage has a constant section from one of its openings to the other emerging on the one hand inside said annular inner channel and on the other hand toward the outside.

6. The watch according to claim 1, wherein the bezel and the middle have adjacent surfaces situated on either side of said annular inner channel and said through passage.

7. The watch according to claim 1, wherein the non-return means further comprises a body, the body comprising the non-return member and the spring, wherein the spring is inserted in the body, stressing it towards the non-return toothing, and wherein the body is mounted in an axial hole of the middle.

8. The watch according to claim 1, wherein the maintaining spring comprises faces engaging annular grooves of the bezel and the middle, the grooves emerging in said annular inner channel.

9. The watch according to claim 1, wherein the through passage extends in an axial direction relative to a middle of a central axis of the watch and has, in the axial direction, a thickness comprised between one third and two thirds of the thickness of the bezel.

10. The watch according to claim 1, wherein the through passage has, in a peripheral direction, a length comprised between one and two times the thickness of the bezel.

11. The watch according to claim 1, wherein the length of said through passage, in the circumferential direction, is at least equal to four times its width, in the direction of the axial thickness of the bezel.

12. The watch according to claim 1, wherein the angular sector is between approximately twenty and thirty degrees.

13. The watch according to claim 1, wherein the at least one annular inner channel comprises a radial part and an axial part, the radial part and the axial part forming an L shaped channel.

14. The watch according to claim 1, wherein the bezel further comprises a shoulder configured to hold the non-return toothing, and wherein the non-return toothing is oriented towards a bottom of an annular groove in the middle.

* * * * *